US006317890B1

(12) United States Patent
Kuhn

(10) Patent No.: US 6,317,890 B1
(45) Date of Patent: Nov. 20, 2001

(54) PROTECTIVE GARMENT OVERLAY APPARATUS

(75) Inventor: Patricia Y. Kuhn, Groton Long Point, CT (US)

(73) Assignee: Caribbean Connections, Sarasota, FL (US)

( * ) Notice: Subject to any disclaimer, the term of this patent is extended or adjusted under 35 U.S.C. 154(b) by 0 days.

(21) Appl. No.: 09/513,745

(22) Filed: Feb. 25, 2000

(51) Int. Cl.[7] ..... A41D 13/04
(52) U.S. Cl. ..... 2/52
(58) Field of Search ..... 2/46, 48, 49.1, 2/49.2, 49.3, 49.4, 49.5, 50, 51, 52; D2/860, 861, 863, 864

(56) References Cited

U.S. PATENT DOCUMENTS

| | | | | |
|---|---|---|---|---|
| 1,493,815 | | 5/1924 | Hogan . | |
| 1,754,581 | | 4/1930 | Siebel | 2/52 |
| 2,100,573 | * | 11/1937 | Spanel | 2/49 |
| 2,366,393 | | 1/1945 | Geisinger | 2/52 |
| 2,418,197 | * | 4/1947 | Sherer | 2/46 |
| 2,423,581 | * | 7/1947 | Clark | 2/49 |
| 2,424,000 | | 7/1947 | Shanker | 2/48 |
| 2,471,331 | | 5/1949 | Lee | 2/48 |
| 2,518,626 | | 8/1950 | Lepper | 24/7 |
| 2,697,223 | | 12/1954 | Geisinger | 2/52 |
| 2,747,192 | * | 5/1956 | Katz | 2/46 |
| 2,782,420 | * | 2/1957 | Barager | 2/49 |
| 2,948,035 | * | 8/1960 | McCarthy | 24/9 |
| 3,115,639 | | 12/1963 | Moszczynski | 2/48 |
| 3,131,399 | | 5/1964 | Murphy et al. | 2/48 |
| 3,146,464 | * | 9/1964 | Burnett | 2/49 |
| 3,328,807 | * | 7/1967 | Strauss | 2/49 |
| 3,416,157 | * | 12/1968 | Marder et al. | 2/49 |
| 3,488,773 | * | 1/1970 | Stemmer | 2/49 |
| 3,619,816 | | 11/1971 | Cowen | 2/49 |
| 3,642,001 | * | 2/1972 | Sabee | 128/287 |
| 3,833,937 | * | 9/1974 | Taylor | 2/46 |
| 3,867,940 | * | 2/1975 | Mesek et al. | 128/287 |
| 3,979,776 | * | 9/1976 | Gruenwald | 2/49 |
| 3,995,321 | * | 12/1976 | Johnson | 2/49 |
| 4,055,183 | * | 10/1977 | Ryan et al. | 128/287 |
| 4,210,144 | * | 7/1980 | Sarge, III et al. | 128/287 |
| 4,423,523 | | 1/1984 | Bodner et al. | 2/49 R |
| 4,523,334 | * | 6/1985 | Lavash | 2/49 |
| 4,660,224 | | 4/1987 | Ashcraft | 2/48 |
| 4,660,226 | * | 4/1987 | Quilling et al. | 2/49 |
| 4,733,411 | | 3/1988 | Foti | 2/49 R |
| 5,031,241 | * | 7/1991 | Weidmann | 2/49 |
| 5,075,897 | | 12/1991 | Daniels | 2/2 |
| 5,220,692 | | 6/1993 | Cox . | |
| 5,491,844 | | 2/1996 | Kehl et al. . | |
| 5,621,916 | * | 4/1997 | Bell | 2/48 |
| 5,672,056 | * | 9/1997 | Fisher et al. | 433/137 |
| 5,956,763 | * | 9/1999 | Blackshear | 2/49.1 |
| 6,047,402 | * | 4/2000 | Chester-Salter | 2/46 |
| 6,079,048 | * | 6/2000 | Campbell | 2/49.1 |

* cited by examiner

*Primary Examiner*—John J. Calvert
*Assistant Examiner*—Alissa L. Hoey

(57) ABSTRACT

A protective garment overlay apparatus includes a napkin portion having a first planar surface and a second planar surface. An attachment device is fixed to the napkin portion and includes a rigid yet manually deformable grip arm extending from the first planar surface. In operation, the grip arm is selectively deformed to secure the napkin portion to an anchoring element.

18 Claims, 5 Drawing Sheets

PROTECTIVE GARMENT OVERLAY APPARATUS

FIELD OF THE INVENTION

The present invention relates generally to a protective garment overlay apparatus, and deals more particularly with an apparatus which is selectively mounted over an individual's clothing so as to provide protection against mishaps involving food or drinks, particularly during travelling or commuting.

BACKGROUND OF THE INVENTION

Many people endure frequent, long distance travelling or commuting as part of their daily work routines, while still others choose to travel for personal reasons, such as vacations. Regardless of their motivation, it is not uncommon for the traveler to partake of food or drink during at least a portion of their trip, often with disastrous results for the clothes worn by the traveler. Complicating this situation is the often cramped seating found in commercial planes, trains and buses, as well as in personal automobiles. Such restricted space allocation for the traveler only increases the chances of an inadvertent spill, especially when the traveler is also the operator of the particular vehicle in which he or she is travelling.

It is known in the art to utilize aprons or napkins to offset the possibility of food or drink stains, however many of these devices typically suffer from complicated operation, that is, requiring two-handed orientation and attachment to the user's body.

Moreover, these known apron or napkin devices commonly utilize separate attachment elements which must be joined together and may therefore be difficult to untie. These attachment elements may also hang from the user so as to create a visually unappealing and possibly dangerous situation for the wearer.

It would therefore be advantageous if an apparatus could be developed which would overlay the clothing of a wearer which is simple in design and effectively operated with minimal effort on the part of the wearer.

Equally advantageous would be an apparatus in which the attachment element(s) were not visible and did not interfere with the wearer's actions.

SUMMARY OF THE INVENTION

It is therefore an object of the present invention to provide a protective garment overlay apparatus which is simple in design and inexpensive to produce.

It is another object of the present invention to provide a protective garment overlay apparatus which may be engaged and disengaged from the clothing of a wearer by a simple one-handed operation.

It is another object of the present invention to provide a protective garment overlay apparatus having a memory retentive attachment device.

It is another object of the present invention to provide a protective garment overlay apparatus capable of maintaining its shape during use.

According to one embodiment of the present invention, a protective garment overlay apparatus includes a napkin portion having a first planar surface and a second planar surface. An attachment device is fixed to the napkin portion and includes a rigid yet manually deformable grip arm extending from the first planar surface. In operation, the grip arm is selectively deformed to secure the napkin portion to an anchoring element.

DETAILED DESCRIPTION OF THE PREFERRED EMBODIMENTS

Figure 1:
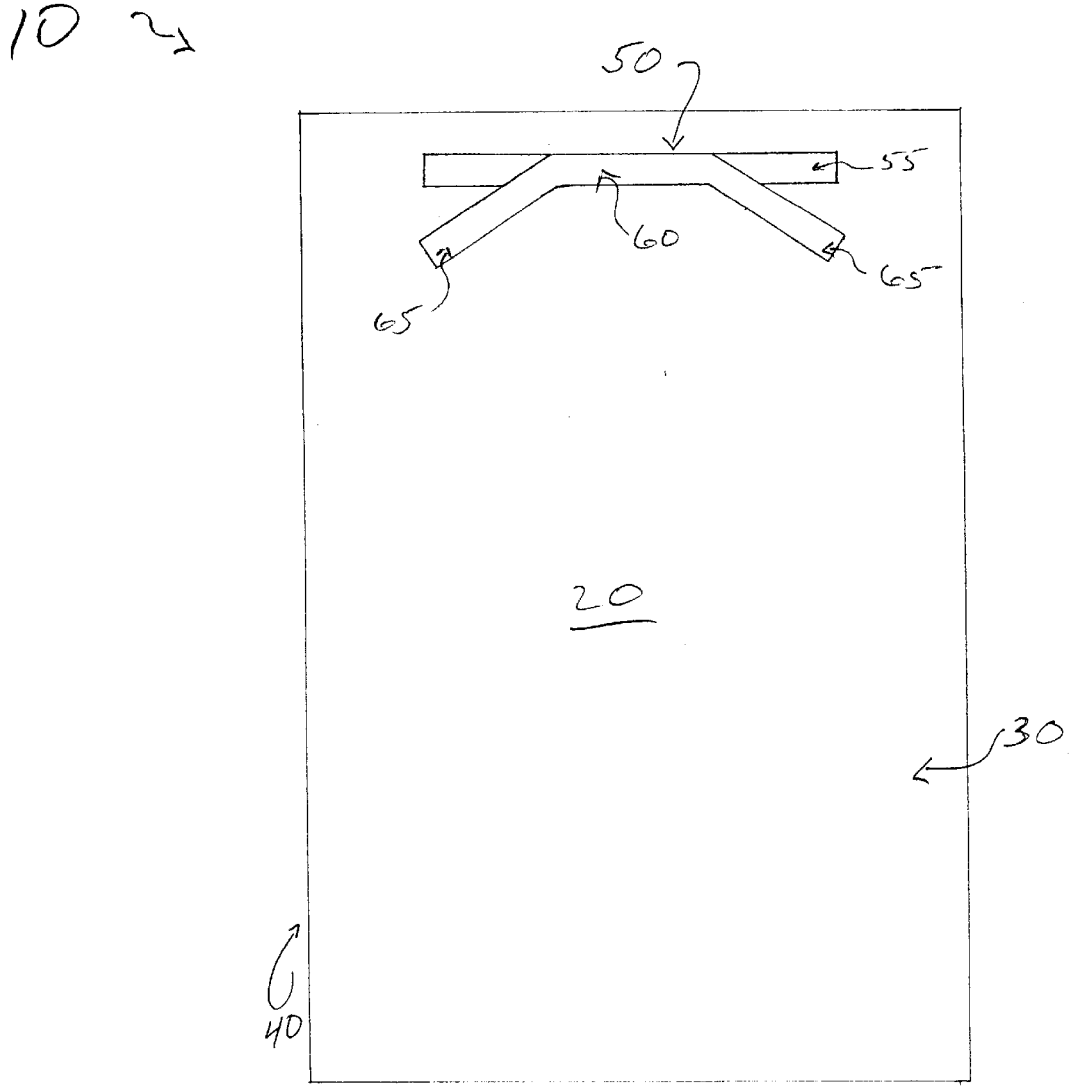
FIG. 1 is a plan view of a protective garment overlay apparatus, according to one embodiment of the present invention.

As illustrated in FIG. 1, a protective garment overlay apparatus 10 includes a napkin portion 20 and a fastening device 50. The napkin portion 20 is depicted as a rectangular covering being approximately 10 inches wide and approximately 14 inches long. The present invention, however, is not limited in this regard as the napkin portion 20 may alternatively be of a size or geometrical configuration which acts to cover the clothing of an individual when in use, as will be described in more detail later.

The napkin portion 20 has a first planar side 30 and an opposing second planar side 40, wherein the first planar side 30 faces and tends to contact the clothing of an individual when the protective garment overlay apparatus 10 is in use. The first and second planar sides, 30 and 40 respectively, may be opposing sides of a unitary swath of material that comprises the napkin portion 20 or, alternatively, may be formed from two or more layered material sheets which, when joined together, form the napkin portion 20. Moreover, the preferred embodiment of the present invention envisions that the first planar side 30 is made from, or coated with, a waterproof, fluid impenetrable material, while the second planar side 40 is made from an absorbent or semi-absorbent material.

The fastening device 50 of the protective garment overlay apparatus 10 is utilized for securing the overlay apparatus 10 to the clothing of an intended user. According to the embodiment depicted in FIG. 1, the fastening device 50 includes a stiffening strip 55 in mating engagement with a gripping strip 60. The stiffening strip and the gripping strip, 55 and 60 respectively, are formed from a deformable yet resilient material, such as but not limited to a strip of metallic material or the like. The gripping strip 60, as well as the stiffening strip 55, may have a plastic, polymer or paper coating so as to protect the intended user from any exposed edges or ends of the metallic material from which they are fashioned. Moreover, although the gripping strip 60 and the stiffening strip 55 are depicted in FIG. 1 as substantially flattened strips of metallic material, the present invention is not limited in this regard as they may be alternatively fashioned as bar elements having circular cross-sections, such as commonly known twist-ties or the like, without departing from the broader aspects of the present invention.

Returning to FIG. 1, the gripping strip 60 is affixed to the stiffening strip 55 about a center section thereof in any commonly known manner, such as but not limited to welding or gluing. The distal ends of the gripping strip 60, however, are not fixed to the stiffening strip 55 but instead are capable of bending approximately orthogonally to the plane of the napkin portion 20, forming two grip arms 65.

In operation, the grip arms 65 may be easily manipulated by a user to bend about an anchoring element, including a portion of the user's clothing, such as but not limited to a tie or the areas between the buttons of a dress shirt, thereby being selectively and releasably fastened over the user's clothing. Moreover, the grip arms 65 may also be secured about seat belts or other structural or restraining devices commonly found in automobiles, airplanes and other conveyances. When utilized in this manner, not only will the napkin portion 20 protect the user's clothing, but the stiffening strip 55 ensures that the napkin portion 20 remains uncrumpled to provide the largest covered area possible.

While the fastening device 50 is depicted as being mounted adjacent one distal end of the napkin portion 20, the present invention is not limited in this regard as the fastening device 50 may be alternatively mounted to other locations of the napkin portion 20 without departing from the broader aspects of the present invention.

Figure 2:
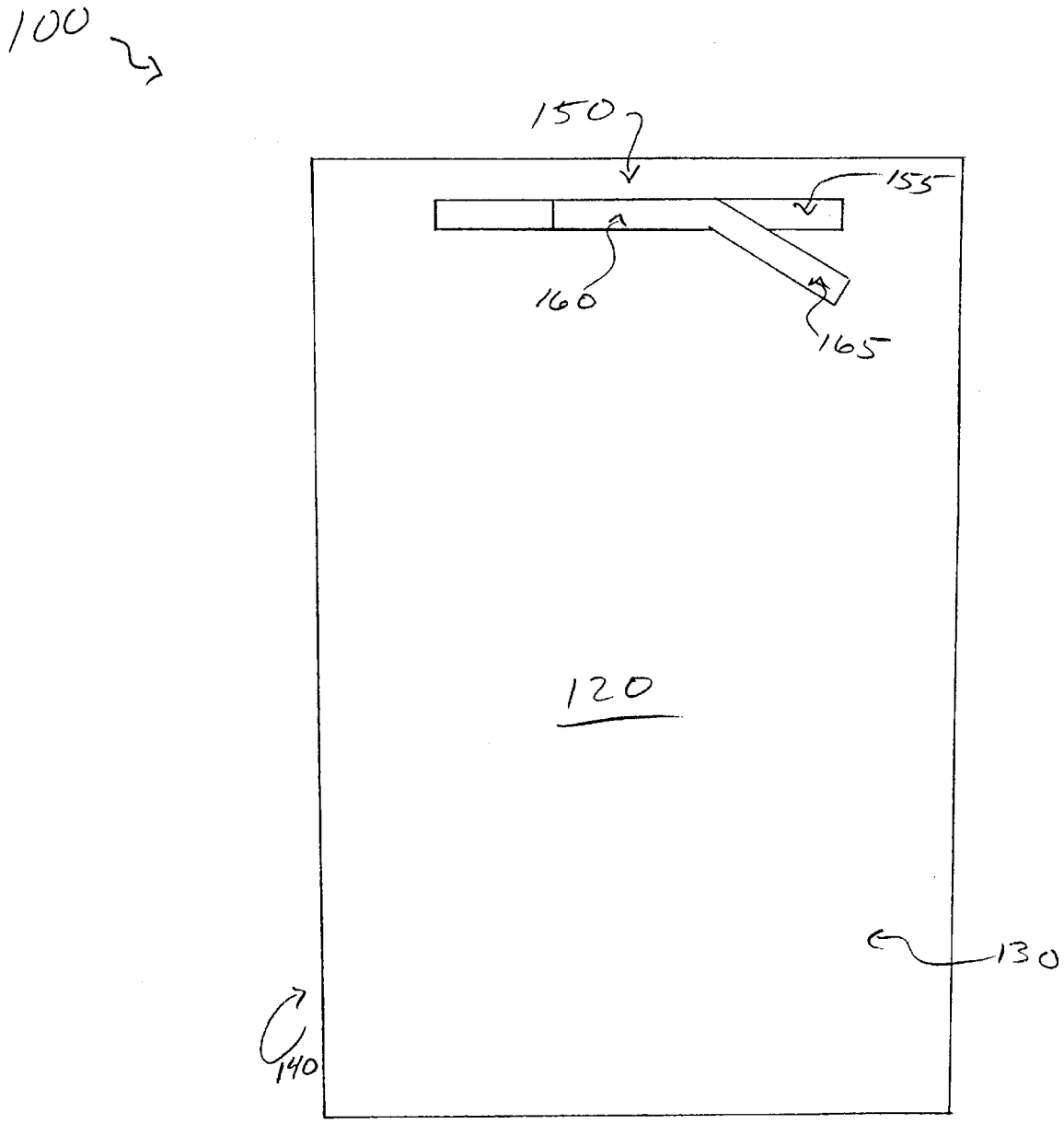
FIG. 2 is a plan view of a protective garment overlay apparatus, according to another embodiment of the present invention.

FIG. 2 illustrates another embodiment of a protective garment overlay apparatus 100 including a napkin portion 120 and a fastening device 150. As depicted in FIG. 2, the napkin portion 120 has a first planar side 130 and an opposing second planar side 140, wherein the first planar side 130 faces and tends to contact the clothing of an individual when the protective garment overlay apparatus 100 is in use. As discussed above in conjunction with the embodiment of FIG. 1, the first and second planar sides, 130 and 140 respectively, may be opposing sides of a unitary swath of material that comprises the napkin portion 120 or, alternatively, may be formed from two or more layered material sheets which, when joined together, form the napkin portion 120.

The fastening device 150 includes a stiffening strip 155 in mating engagement with a gripping strip 160. The stiffening strip and the gripping strip, 155 and 160 respectively, are formed from a deformable yet resilient material, such as but not limited to a strip of metallic material or the like. The gripping strip 160 is affixed to the stiffening strip 155 about a center section thereof in any commonly known manner, such as but not limited to welding or gluing. In the embodiment depicted in FIG. 2, however, the gripping strip 160 has only one distal end which is not fixed to the stiffening strip 155 and is capable of bending approximately orthogonal to the plane of the napkin portion 120, thereby forming a single grip arm 165.

In operation, the grip arm 165 accomplishes the previously disclosed task of being easily manipulated by a user to bend about an anchoring element, including a portion of the user's clothing, such as but not limited to a tie or the areas between the buttons of a dress shirt, thereby being selectively and releasably fastened over the user's clothing. Moreover, the grip arm 165 may also be secured about seat belts or other structural or restraining devices commonly found in automobiles, airplanes and other conveyances. By having only one such grip arm 165, the present embodiment simplifies attachment, while the stiffening strip 155 continues to ensure that the napkin portion 120 remains uncrumpled to provide the largest covered area possible.

Figure 3:
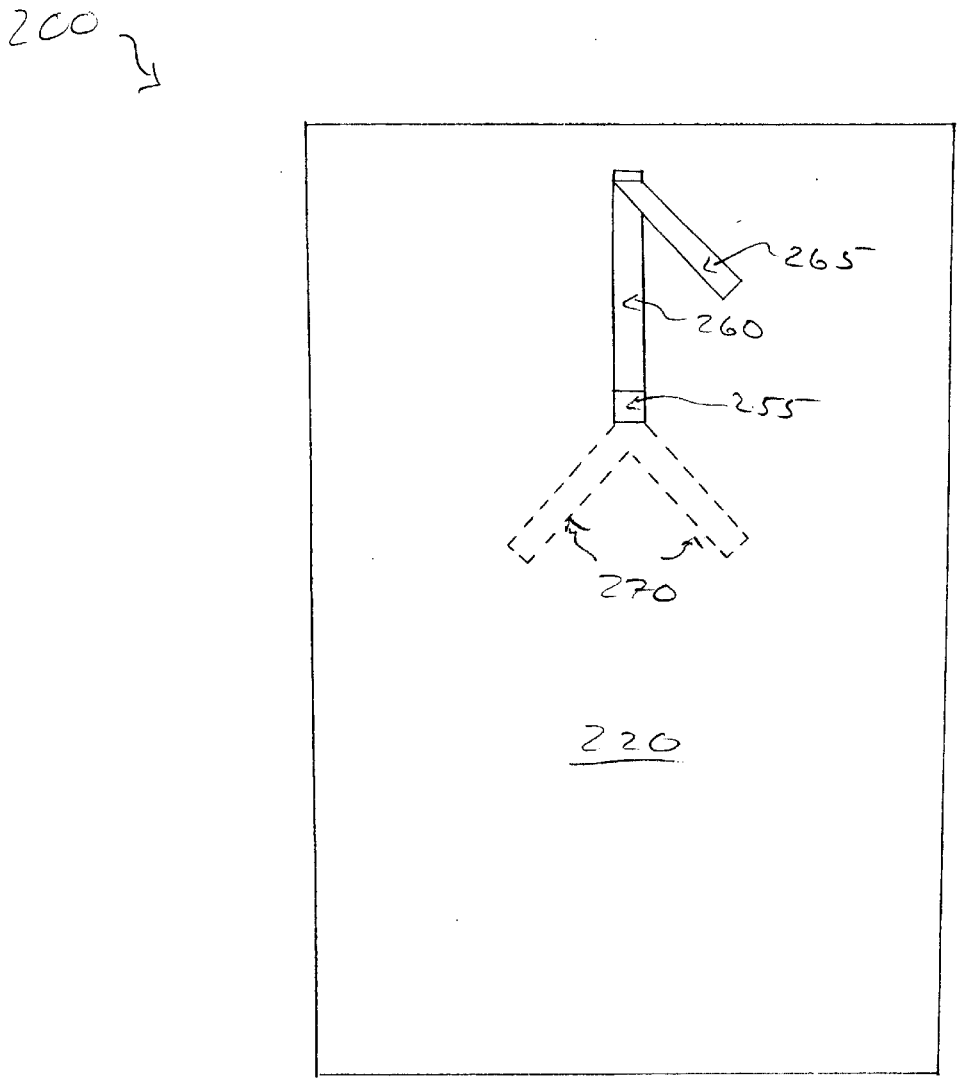
FIG. 3 is a plan view of a protective garment overlay apparatus, according to another embodiment of the present invention.

FIG. 3 illustrates yet another embodiment of the present invention whereby a protective garment overlay apparatus 200 includes a gripping strip 260 having a single grip arm 265 oriented approximately 90° from the grip arms depicted in FIGS. 1 and 2. With this orientation, the grip arm 265 may be easily manipulated to attach to the collar portion of a shirt, such as a tee-shirt, or to a seat belt, in those circumstances where a user is not wearing, for example, a tie or a dress shirt.

FIG. 3 also depicts how a stiffening strip 255 may be augmented to include stiffening arms 270 to further increase the structural stability of the protective garment overlay apparatus 200. It should be readily appreciated that the stiffening arms 270 may be of any length or orientation, such as but not limited to extending along the borders of the napkin portion 220 or down the middle thereof, without departing from the broader aspects of the present invention.

Figure 4A:
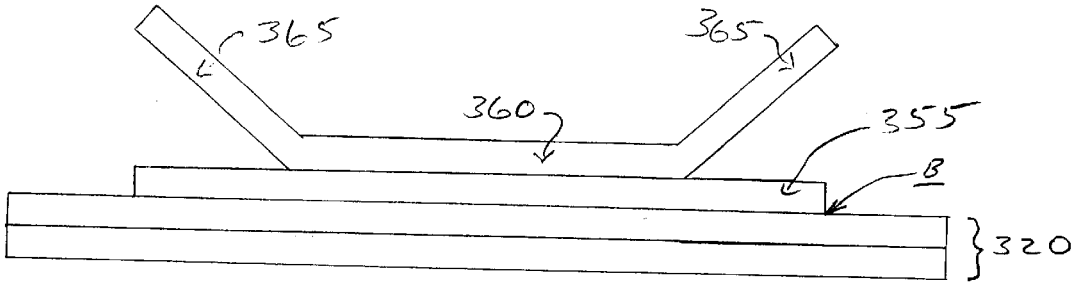
FIGS. 4*a*–4*c* are sectional views taken through various embodiments of the protective garment overlay apparatus.

While FIGS. 1–3 are primarily concerned with alternative embodiments of the protective garment overlay apparatus in its entirety, the specific manner in which the stiffening and gripping strips may be attached to the napkin portion will now be described. FIG. 4*a* depicts the cross-sectional view of a first manner in which a stiffening strip 355 may be attached to a napkin portion 320. As discussed previously, the napkin portion 320 may be either a unitary swath of material having planar sides with differing absorption characteristics or, alternatively, may be formed from two or more layered material sheets, one of which being a waterproof, fluid impenetrable material, while the other being an absorbent or semi-absorbent material.

As depicted in FIG. 4*a,* the stiffening strip 355 is attached to one planar side of the napkin portion 320 through the use of a glue or other adhesive at their common boundary, B. As discussed previously, the center section of a gripping strip 360 is mated to the stiffening strip 355 via welding, gluing or the like, an arrangement which allows for subsequent free manipulation of the grip arms 365.

Figure 4B:
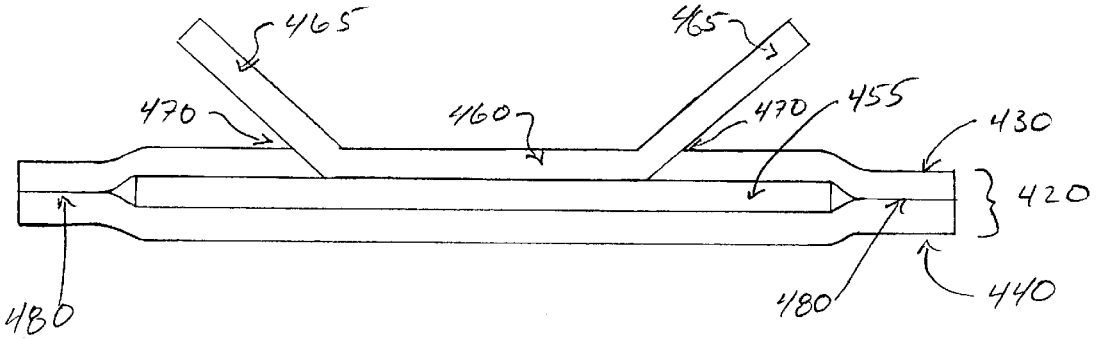

FIG. 4*b* illustrates the particular embodiment where the napkin portion 420 is formed from two, layered material sheets having a first waterproof, fluid impenetrable sheet 430 and a second absorbent or semi-absorbent material sheet 440. As depicted in the cross-sectional view of FIG. 4*b,* a stiffening strip 455 is fixed between the first and second material sheets, 430 and 440 respectively, and anchored in place by glue or other adhesives. The center section of a gripping strip 460 is mated to the stiffening strip 455 via welding, gluing or the like, leaving grip arms 465 to protrude from a pair of grip holes 470 formed in the first material sheet 430. The planar surfaces of the first and second material sheets, 430 and 440 respectively, may be mated to one another by gluing, sewing or thermal-sealing the first and seconds material sheets, 430 and 440, along a common boundary area 480.

Figure 4C:
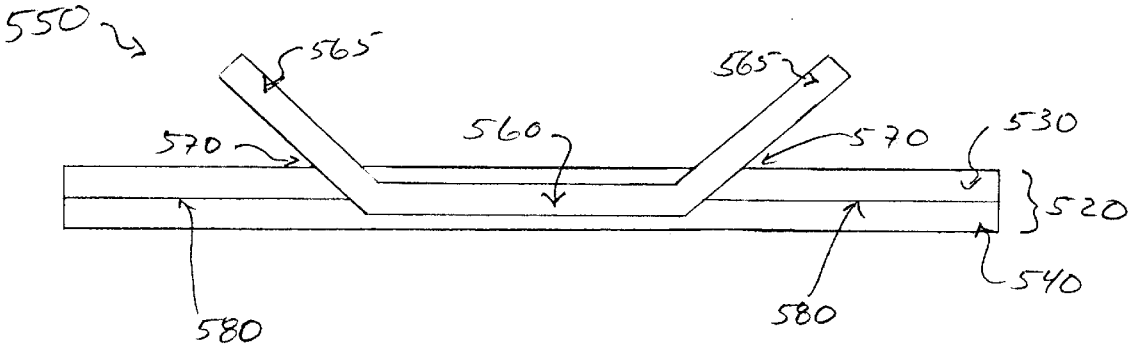

FIG. 4*c* depicts the cross-sectional view of another manner in which a fastening device 550 may be attached to a napkin portion 520 where the napkin portion 520 is formed from two, layered material sheets having a first waterproof, fluid impenetrable sheet 530 and a second absorbent or semi-absorbent material sheet 540. As depicted in the cross-sectional view of FIG. 4*c,* a gripping strip 560 is fixed between the first and second material sheets, 530 and 540 respectively, and anchored in place by glue or other adhesives. A pair of grip arms 565 protrude from a pair of grip holes 570 formed in the first material sheet 530. The planar surfaces of the first and second material sheets, 530 and 540 respectively, may be mated to one another by gluing, sewing or thermal-sealing the first and second material sheets, 530 and 540, along a common boundary area 580.

While the embodiment depicted in FIG. 4*c* illustrates a fastening device 550 which does not utilize a separate stiffening strip, it will be readily appreciated that those embodiments shown in FIGS. 1–4*a* may be similarly fashioned so as to integrate only the gripping strip with the material of the napkin portion, without departing from the broader aspects of the present invention.

Figure 5:
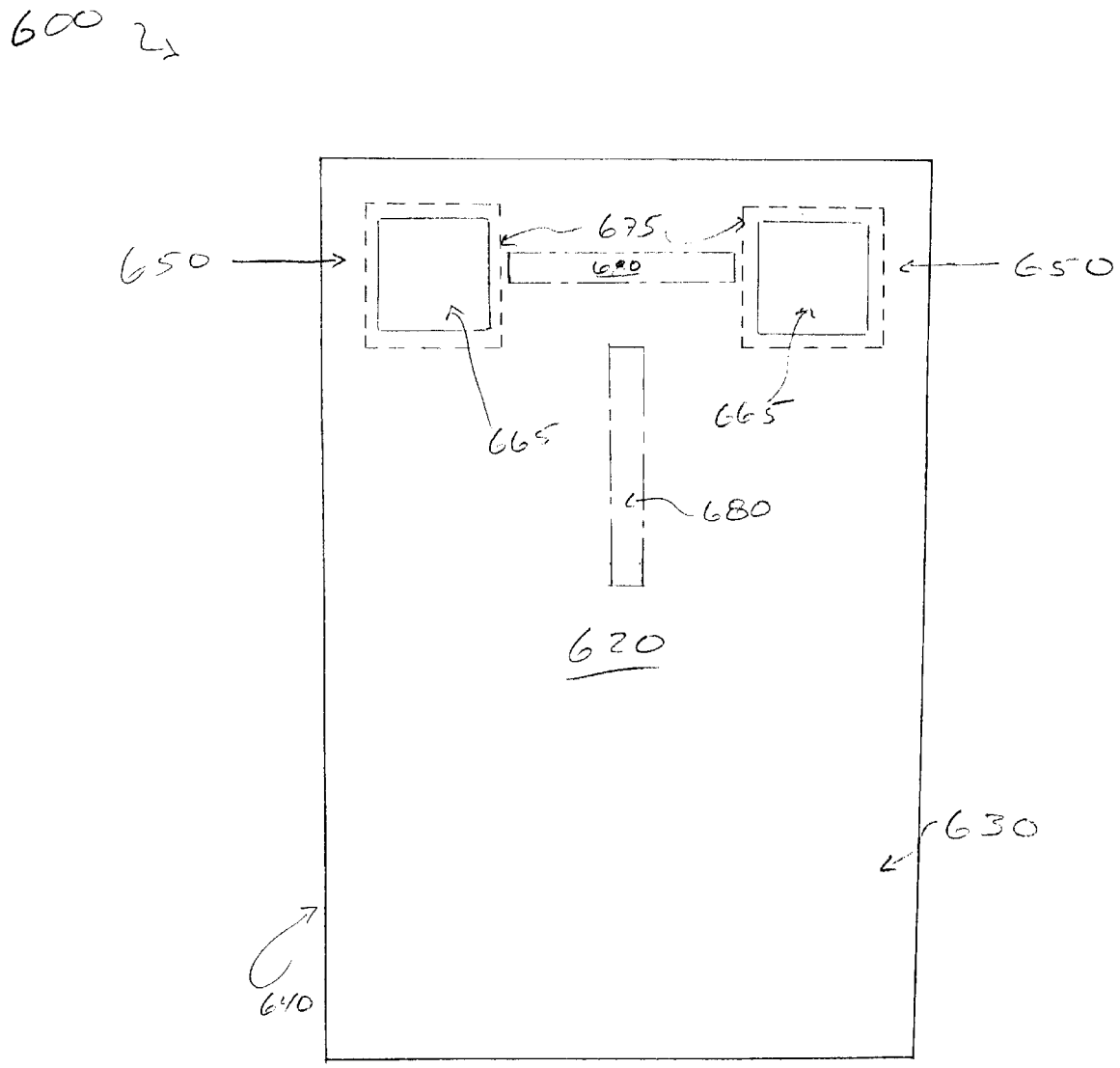
FIG. 5 is a plan view of a protective garment overlay apparatus, according to another embodiment of the present invention.

FIG. 5 illustrates another embodiment of a protective garment overlay apparatus 600 including a napkin portion 620 and a pair of fastening devices 650. As depicted in FIG. 5, the napkin portion 620 has a first planar side 630 and an opposing second planar side 640, wherein the first planar side 630 faces and tends to contact the clothing of an individual when the protective garment overlay apparatus 600 is in use. As discussed above in conjunction with the embodiment of FIG. 1, the first and second planar sides, 630 and 640 respectively, may be opposing sides of a unitary swath of material that comprises the napkin portion 620 or, alternatively, may be formed from two or more layered material sheets which, when joined together, form the napkin portion 620.

As depicted in FIG. 5, the fastening devices 650 each include an attachment area 665 having a cover element 675. The attachment areas 665 operate to affix the napkin portion 620 to the clothes of an intended user and may be fashioned as a hook and loop fastener, such as Velcro® or the like, or rather, an adhesive patch such as is found on commonly known note pads or the like. The cover elements 675 overlie the attachment areas 665 and serve to protect the attachment areas from contamination until being removed by a user.

While FIG. 5 illustrates the square attachment areas 665 being located adjacent two corners of the napkin portion 620, the present invention is not limited in this regard as the attachment areas 665 may be of any geometrical shape or size and may be located on any surface portion of the first planar side 630 without departing from the broader aspects of the present invention. Moreover, it will be readily apparent that any number of attachment areas may be utilized, as appropriate, depending on the size and material of the napkin portion 620. The present embodiment also contemplates the use of stiffening strips 680 (shown in phantom) in conjunction with the attachment areas 665 to provide for structural support of the napkin portion 620 when in use.

As will be appreciated by the foregoing discussion of FIGS. 1–4*c*, a major aspect, therefore, of the present invention is that the stiffening and gripping strips each have qualities of shape retention in order to maintain their shape after being manipulated by an intended user. In this manner, a user may bend or otherwise manipulate the gripping strip so as to attach the overlay apparatus to the clothing of a user without complicated or otherwise onerous operation. Moreover, by utilizing strips of metallic material a degree of rigidity, and therefore consistency in structural form, may be afforded to the napkin portion of the overlay apparatus.

It is another important aspect of the present invention that an overlay apparatus, such as disclosed in conjunction with FIG. 5, may be provided which advantageously protects the clothes of an intended user without the need for any manipulation of attachment elements.

While preferred embodiments have been shown and described, various modifications and substitutions may be made without departing from the spirit and scope of the present invention. Accordingly, it is to be understood that the present invention has been described by way of example, and not by limitation.

What is claimed is:

1. A protective garment overlay apparatus, comprising:

a napkin portion comprising a first sheet and a second sheet being mated to one another, said first and second sheets thereby each having an exposed planar surface and a shared planar surface, said exposed planar surface of said first sheet comprising a first planar surface and said exposed planar surface of said second sheet comprising a second planar surface;

an attachment device fixed to said napkin portion and including a gripping strip having a rigid yet manually deformable grip arm disposed on a distal end thereof, said gripping strip being fixed between said first and second sheets with said grip arm protruding through an aperture in said first planar surface; and wherein said grip arm is selectively deformed to secure said napkin portion to an anchoring element.

2. A protective garment overlay apparatus according to claim 1, wherein:

said grip arm is one of a metallic strip and a metallic rod.

3. A protective garment overlay apparatus according to claim 2, wherein:

said grip arm is coated in one of a plastic and a paper material.

4. A protective garment overlay apparatus according to claim 1, wherein:

said attachment device further comprises a stiffening strip and a gripping strip, wherein a center section of said gripping strip is fixed to a center section of said stiffening strip; and a distal end of said gripping strip comprises said grip arm.

5. A protective garment overlay apparatus according to claim 4, wherein:

said stiffening strip is fixed to said first planar surface.

6. A protective garment overlay apparatus according to claim 5, wherein:

said first planar surface is water repellant; and said second planar surface is semi-absorbent.

7. A protective garment overlay apparatus according to claim 6, wherein:

said attachment device is oriented adjacent a distal end of said napkin portion.

8. A protective garment overlay apparatus according to claim 4, wherein:

said napkin portion comprises a first sheet and a second sheet being mated to one another, said first and second sheets thereby each having an exposed planar surface and a shared planar surface;

said exposed planar surface of said first sheet comprising said first planar surface;

said exposed planar surface of said second sheet comprising said second planar surface;

said stiffening strip and said center section of said gripping strip are fixed between said first and second sheets; and said grip arm protrudes through an aperture in said first planar surface.

9. A protective garment overlay apparatus according to claim 8, wherein:

said first planar surface is water repellant; and said second planar surface is semi-absorbent.

10. A protective garment overlay apparatus according to claim 9, wherein:

said attachment device is oriented adjacent a distal end of said napkin portion.

11. A protective garment overlay apparatus according to claim 1, wherein:

said gripping strip is fixed to said first planar surface.

12. A protective garment overlay apparatus according to claim 11, wherein:

said first planar surface is water repellant; and said second planar surface is semi-absorbent.

13. A protective garment overlay apparatus according to claim 12, wherein:

said attachment device is oriented adjacent a distal end of said napkin portion.

14. A protective garment overlay apparatus according to claim 1, wherein:

said first planar surface is water repellant; and said second planar surface is semi-absorbent.

15. A protective garment overlay apparatus according to claim 14, wherein:

said attachment device is oriented adjacent a distal end of said napkin portion.

16. A protective garment overlay apparatus, comprising:

a napkin portion comprising a first sheet and a second sheet being mated to one another, said first and second sheets thereby each having an exposed planar surface and a shared planar surface, said exposed planar surface of said first sheet comprising a first planar surface and said exposed planar surface of said second sheet comprising a second planar surface;

a stiffening strip fixed between said first and second sheets to provide structural support for said napkin portion; and an attachment patch fixed to said first planar surface, said attachment patch being protected by a removable cover, wherein said attachment patch is selectively exposed to secure said napkin portion to an anchoring element.

17. A protective garment overlay apparatus according to claim 16, wherein:

said attachment patch is comprised of a hook and loop fastener;

said first planar surface is water repellant; and said second planar surface is semi-absorbent.

18. A protective garment overlay apparatus according to claim 16, wherein:

said attachment patch is comprised of a tacky adhesive;

said first planar surface is water repellant; and said second planar surface is semi-absorbent.

* * * * *